US006471539B1

(12) United States Patent
Yu

(10) Patent No.: US 6,471,539 B1
(45) Date of Patent: Oct. 29, 2002

(54) ELECTRICAL CONNECTOR COUPLE HAVING MATING INDICATION DEVICE

(75) Inventor: Hung-Chi Yu, Hsi-Chih (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/011,021

(22) Filed: Dec. 4, 2001

(51) Int. Cl.[7] ..... H01R 3/00
(52) U.S. Cl. ..... 439/489; 439/74
(58) Field of Search ..... 439/489, 74

(56) References Cited

U.S. PATENT DOCUMENTS 5,167,528 A * 12/1992 Nishiyama et al. ..... 439/489
5,904,581 A * 5/1999 Pope et al. ..... 439/74
6,250,935 B1 * 6/2001 Mochizuki et al. ..... 439/74

* cited by examiner

*Primary Examiner*—Gary F. Paumen
(74) *Attorney, Agent, or Firm*—Wei Te Chung

(57) ABSTRACT

An electrical connector couple comprises a first connector and a second connector. The first connector comprises an insulative housing and a plurality of first contacts. The first insulative housing has a plurality of contact-receiving passages. At least one contact-receiving passage is defined as a locating slot. The second connector comprises a second insulative housing and a plurality of second contacts. The second contact corresponding to the locating slot is defined as a locating contact. During mating the first and the second connectors, the locating contact hits the locating slot and a sound made by the hit indicates completeness of the connector couple mating.

1 Claim, 4 Drawing Sheets

ELECTRICAL CONNECTOR COUPLE HAVING MATING INDICATION DEVICE

BACKGROUND OF THE INVENTION

1. Field of the Invention

The present invention relates to electrical connectors, especially to an electrical connector couple having mating indication device for indicating mating situation between the connector couple.

2. Description of the Prior Art

Conventional board to board (BTB) connector assembly comprises a first connector and a second connector. Due to space limitation, the configuration of the BTB connector is small and this results in that housing of the BTB connector is fragile, whereby when the first and second connectors are mating, inappropriate mating force will damage the connectors. The conventional BTB connector cannot indicate the mating situation of the connectors, so there will be two undesired conditions. One condition is that the connector has mated completely, but the user does not know and still pushes the BTB connectors together. This may result in damage of contacts and even housing of the BTB connector. The second condition is that the connector has not mated completely, but the user does not know and stops pushing the BTB connectors together. This may result in failure of electrical connection between the first and second connectors.

In Taiwan patent Application No. 84218771, a BTB connector is disclosed. However, when two such connectors are mated, the user cannot determine whether the connector couple (i.e., the two connectors) has completely mated, and this can result in the two conditions described above. Therefore, a BTB connector with mating situation indicating device is desired to overcome the shortcoming of the conventional BTB connector.

SUMMARY OF THE INVENTION

An object of the present invention is to provide an electrical connector couple having a mating indication device for indicating the mating situation of the connector couple.

To achieve the above object, an electrical connector in accordance with a preferred embodiment of the present invention comprises a first connector and a second connector. The first connector comprises a first insulative housing and a plurality of first contacts. The first insulative housing has a plurality of contact-receiving passages. At least one contact-receiving passage is defined as locating slot. The locating slot comprises a first and second portions which are separated apart from each other along a horizon direction. The locating slot does not receive any first contact. The second connector comprises a second insulative housing and a plurality of second contacts. The second contact corresponding to the locating slot is defined as locating contact. During mating the first and the second connectors, the locating contact engages the locating slot to produce an audible indication by deflecting from the first portion to the second portion and hitting the second portion.

Other objects, advantages and novel features of the present invention will be drawn from the following detailed description of preferred embodiments of the present invention with attached drawings, in which:

DESCRIPTION OF PREFERRED EMBODIMENTS OF THE INVENTION

Figure 1:
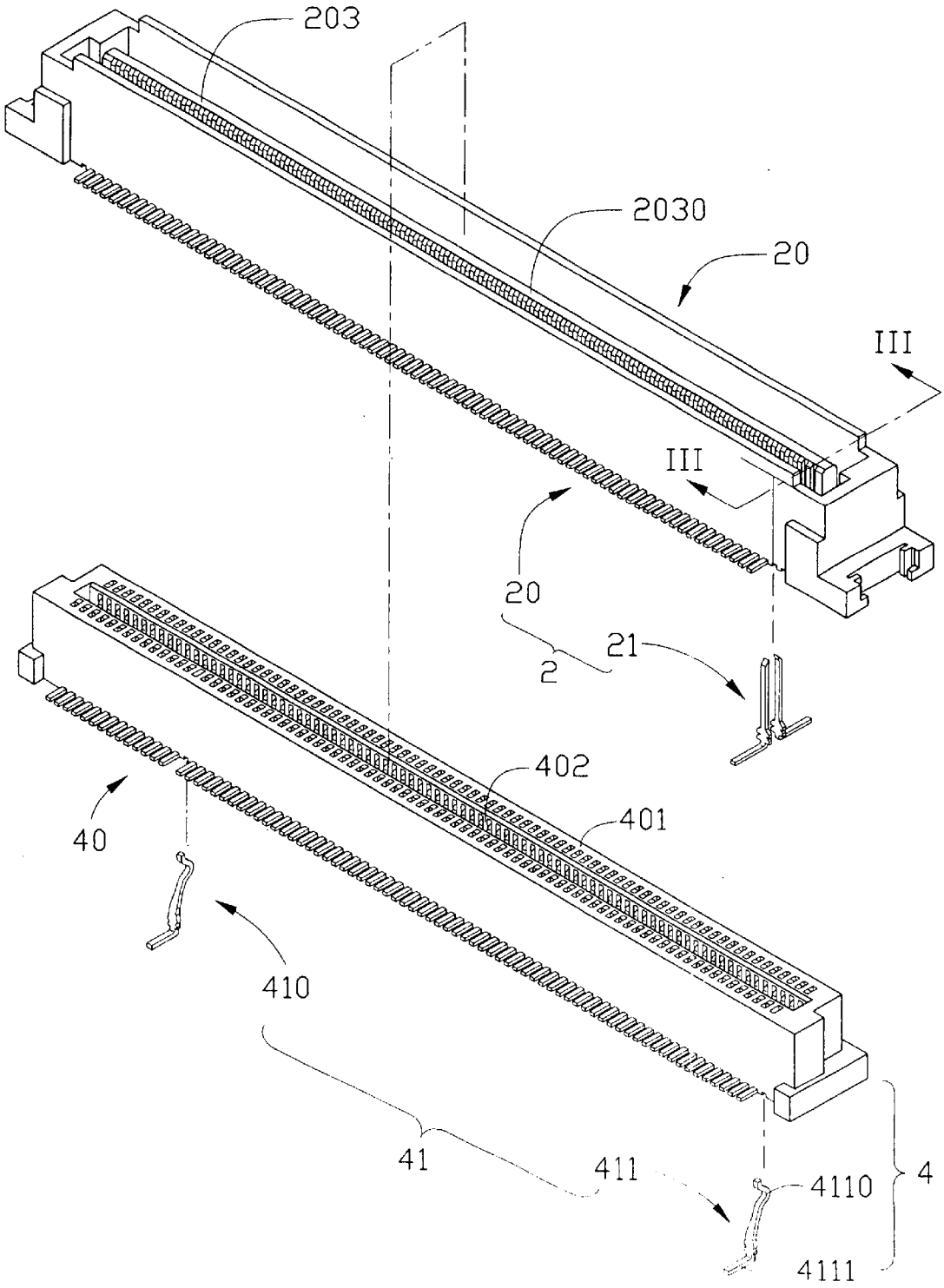
FIG. 1 is an exploded view of a connector couple in accordance with a preferred embodiment of the present invention.

Reference will now be made to the drawing figures to describe the present invention in detail.

As shown in FIG. 1, an electrical connector couple in accordance with a preferred embodiment of the present invention comprises a first connector 2 and a second connector 4 for being soldered to two different printed circuit boards (PCB) (not shown) and for electrically connecting the two PCBs. The first connector 2 comprises a first insulative housing 20 and a plurality of first contacts 21. The first insulative housing 20 has an elongate configuration with a center rib 203 defined therein. A first mating surface 2030 is formed on the center rib 203 for mating with the second connector 4. A plurality of contact-receiving passages 201 are defined in two sidewalls of the center rib 203 for receiving a plurality of first contacts 21. The second connector 4 comprises a second insulative housing 40 and a plurality of second contacts 41. The second insulative housing 40 has a second mating surface 401 with a lot 402 opened therein for engaging with the first connector 2.

Figure 2:
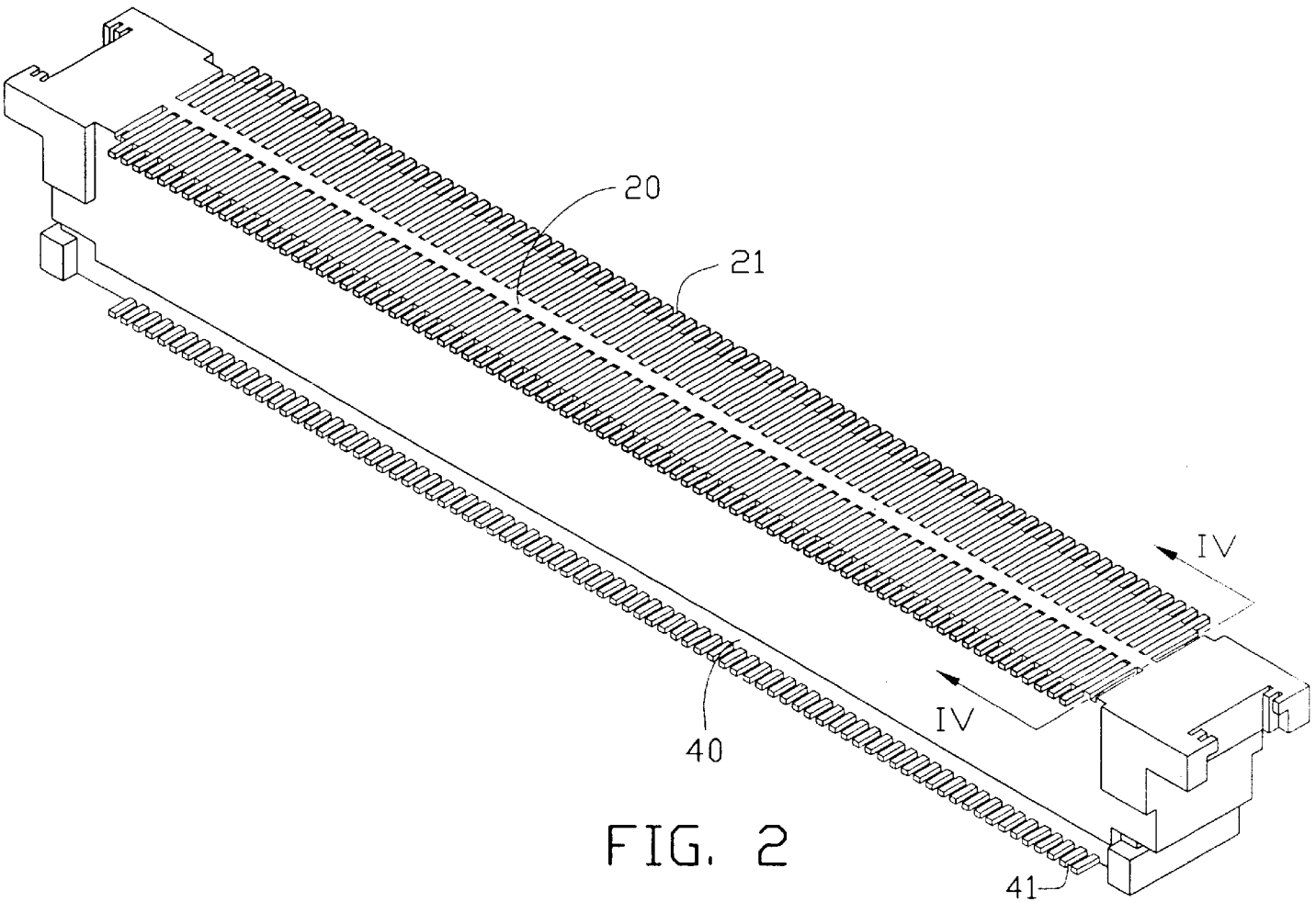
FIG. 2 is an assembled view of the connector couple of FIG. 1.
Figure 3:
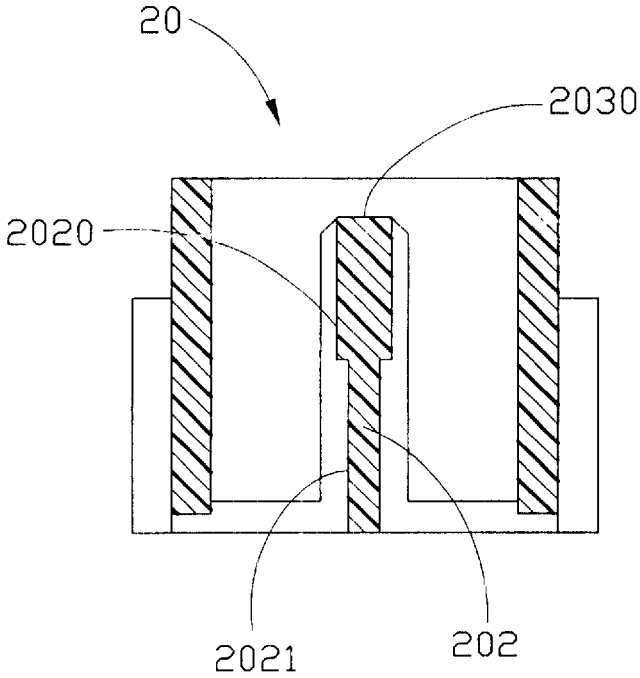
FIG. 3 is a cross sectional view taken along line III—III of FIG. 1.

As shown in FIGS. 2 and 3, the contact-receiving passages 201 open to the first insulative housing 20, and at least one contact-receiving passage 201 is defined as a locating slot 202. The contact-receiving passages 201 which are located on the opposite end of the elongated first insulative housing 20 are defined as the locating slots 202 in accordance with the preferred embodiment of the present invention. The locating slot 202 comprises a guide portion 2020 and a locating portion 2021. The guide portion 2020 is defined adjacent to the first mating surface 2030. The guide portion 2020 is spaced apart from the locating portion 2021 along a horizontal direction. The second contacts 41 corresponding to the first contacts 21 are defined as the electrically connecting contacts 410. The second contacts 41 corresponding to the locating slots 202 are defined as the locating contacts 411. The locating contact 411 comprises a contact portion 4110 and a solder portion 4111. The solder portion 4111 extends from the second insulative housing 40 and is bent to be soldered to a circuit board (not shown). The contact portion 4110 is engaged with the locating portion 2021 of the locating slot 202.

Figure 4:
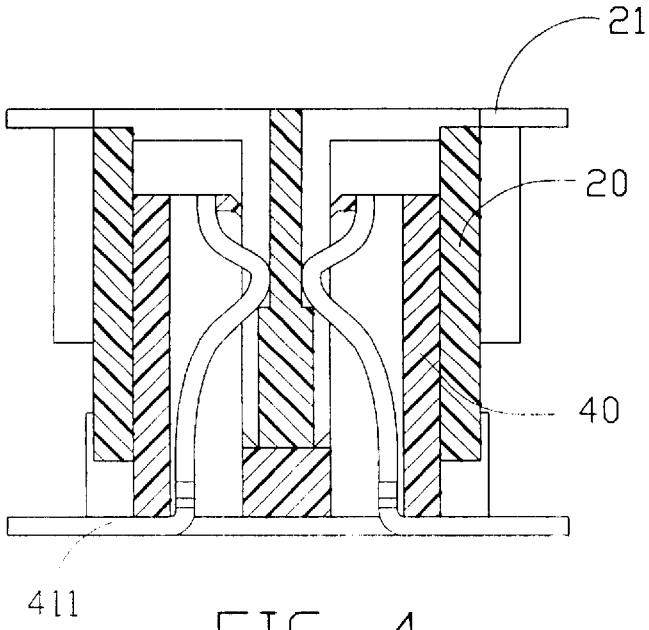
FIG. 4 is a cross sectional view taken along line IV—IV of FIG. 2.

Referring to FIG. 4, when the first and second connectors 2, 4 are mated together, the center rib 203 of the first connector 2 is inserted in the slot 402 along the second mating surface 401 of the second connector 4. During insertion of the first connector 2, the contact portion 4110 of the locating contact 411 slides along the guide portion 2020 of the locating slot 202. When the first connector 2 is inserted completely, the contact portion 4110 of the locating contact 411 slides just beyond the guide portion 2020 to the locating portion 2021 and then the contact portion 4110 deflects and hits on the locating portion 2021, whereby a noticeable sound or an impact made by the hit will indicate the completeness of the connector couple mating, and undesired damage due to the continued pressing by the user will be avoided. Understandably, the contact portion of the locating contact may perform somewhat retention in mating.

Figure 5A:
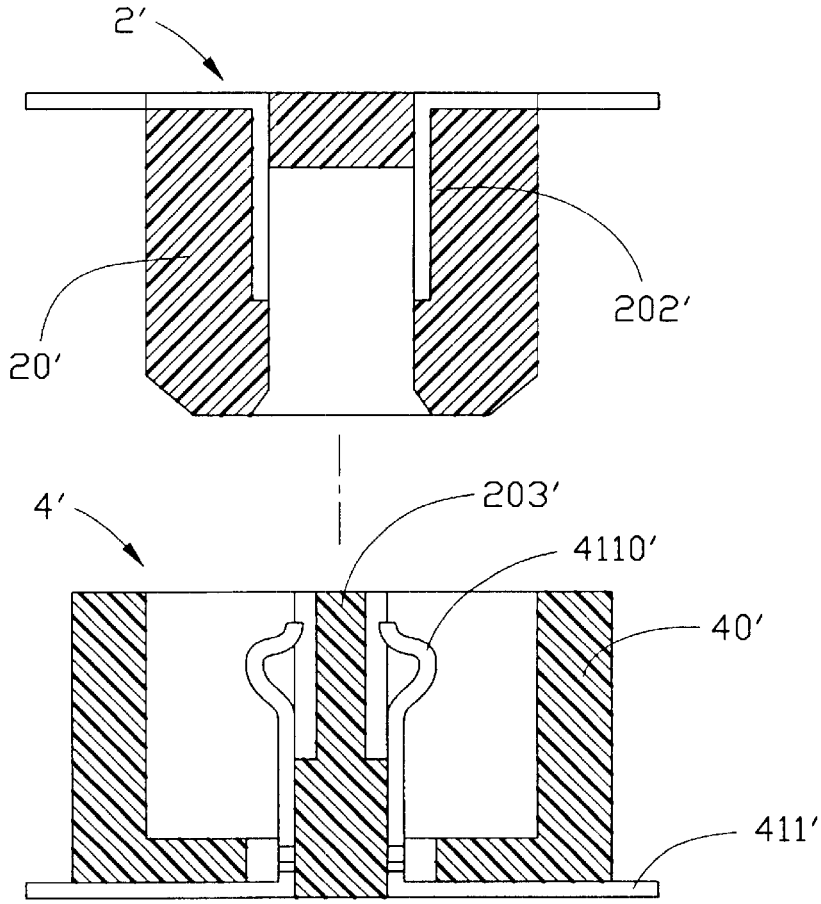
FIG. 5A is an exploded and cross sectional view of another connector couple in accordance with another embodiment of the present invention.
Figure 5B:
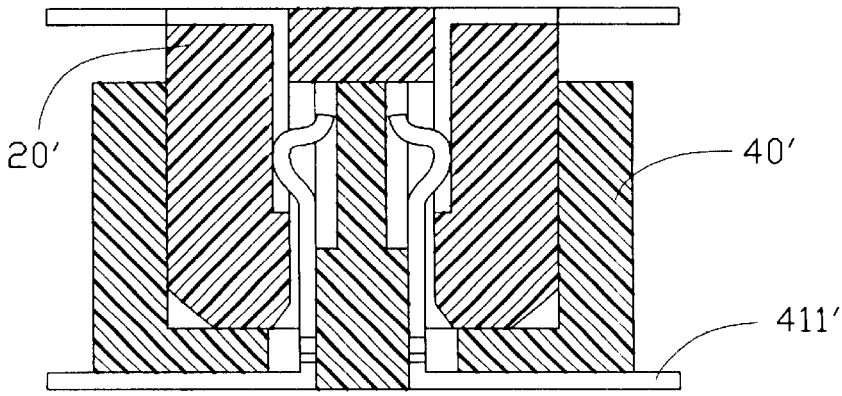
FIG. 5B is an assembled view of FIG. 5A.

Referring to FIGS. 5A and 5B, showing another embodiment in accordance with the present invention, a first connector 2' has a first insulative housing 20' with contact-receiving passages opened in two inner sidewalls of the first insulative housing 20'. Thus locating slot 202' is equally opened in the inner sidewalls. A second connector 4' has a second insulative housing 40' with a center rib 203' defined therein. Contact portion 4110' of locating contact 411' is bent to a reverse direction relative to the contact portion 4110 of the first embodiment in accordance with the present invention. With a different structure, the second embodiment still achieves the mating situation indication function.

Although the present invention has been described with reference to particular embodiments, it is not to be construed as being limited thereto. Various alterations and modifications can be made to the embodiments without in any way departing from the scope or spirit of the present invention as defined in the appended claims.

What is claimed is:

1. An electrical connector couple comprising:

a first connector comprising a first insulative housing and a plurality of first contacts, the first insulative housing having a plurality of contact-receiving passages, two of the plurality of contact-receiving passages being locating slots at opposite ends of the first insulative housing, each locating slot comprising first and second portions which are separated from each other; and a second connector comprising a second insulative housing and a plurality of second contacts, two second contacts each corresponding to the respective locating slot being a locating contact, the locating contact being engagable with the locating slot to produce an audible indication by deflecting from the first portion to the second portion and the hitting the second portion, wherein the locating contact comprises a contact portion and a solder portion, the solder portion extending out of the second insulative housing perpendicularly;

wherein the second insulative housing has a mating surface and a slot opened therein for mating with the first connector;

wherein the first insulative housing comprises a center rib and the contact-receiving passages are located in the center rib.

* * * * *